US007932449B1

(12) United States Patent
Minakuchi

(10) Patent No.: US 7,932,449 B1
(45) Date of Patent: Apr. 26, 2011

(54) NECK JOINT STRUCTURE FOR STRINGED MUSICAL INSTRUMENT

(75) Inventor: Kiyoshi Minakuchi, South Pasadena, CA (US)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 12/609,286

(22) Filed: Oct. 30, 2009

(51) Int. Cl.
*G10D 3/00* (2006.01)

(52) U.S. Cl. ..... 84/293

(58) Field of Classification Search ..... 84/293
See application file for complete search history.

(56) References Cited

U.S. PATENT DOCUMENTS

| | | | | |
|---|---|---|---|---|
| 2,793,556 | A * | 5/1957 | Maccaferri | 84/267 |
| 3,196,730 | A * | 7/1965 | Daniel | 84/293 |
| 3,550,496 | A * | 12/1970 | Fender | 84/293 |
| 4,836,077 | A * | 6/1989 | Hogue | 84/293 |
| 4,896,578 | A * | 1/1990 | Marx | 84/313 |
| 5,786,539 | A * | 7/1998 | Steinberger | 84/293 |
| 5,886,272 | A * | 3/1999 | Regenberg | 84/293 |
| 6,265,648 | B1 * | 7/2001 | Steinberger | 84/293 |
| 6,831,218 | B2 * | 12/2004 | Steinberger | 84/293 |
| 7,208,664 | B1 * | 4/2007 | Regenberg et al. | 84/267 |
| 7,476,790 | B2 * | 1/2009 | Breedlove et al. | 84/293 |
| 7,687,698 | B2 * | 3/2010 | Kim | 84/293 |
| 2001/0010186 | A1 | 8/2001 | Steinberger | |
| 2003/0145712 | A1 | 8/2003 | Steinberger | |
| 2010/0024623 | A1 | 2/2010 | Kim | |

FOREIGN PATENT DOCUMENTS

| | | | |
|---|---|---|---|
| JP | S63-195378 | | 12/1988 |
| JP | 2000-187481 | A | 7/2000 |
| WO | WO-00/70599 | A1 | 11/2000 |
| WO | WO-2010/070363 | A1 | 6/2010 |

* cited by examiner

*Primary Examiner* — Jeffrey Donels
*Assistant Examiner* — Robert W Horn
(74) *Attorney, Agent, or Firm* — Dickstein Shapiro LLP

(57) ABSTRACT

A neck joint structure which has an opening on the main face of a body in the thickness direction, which has openings on the side faces of the body extending in the thickness direction, and into which at least a part of the base-end portion of a neck is inserted is formed in the body of a stringed musical instrument. The neck joint structure includes a recessed end face which is brought into contact with the end face of the base-end portion constituting the base of the neck in the longitudinal direction and a recessed bottom face which is brought into contact with the main contact face of the base-end portion that forms a corner together with the end face in the thickness direction of the neck. The neck joint structure of the stringed musical instrument is equipped with a joint member fixing the body and the neck, i.e. a slanting joint member which is screwed into the body and the neck via the corner between the recessed bottom face and the recessed end face of the body and via the corner between the main contact face and the end face of the neck in the state in which the screwing direction thereof is slanted to the distal end of the neck in the longitudinal direction relative to the thickness direction of the body and the neck.

9 Claims, 6 Drawing Sheets

NECK JOINT STRUCTURE FOR STRINGED MUSICAL INSTRUMENT

BACKGROUND OF THE INVENTION

1. Field of the Invention

The present invention relates to neck joint structures for stringed musical instruments in which necks of stringed musical instruments are fixed to bodies.

2. Background Art

Conventionally, various types of stringed musical instruments such as electric guitars, acoustic guitars, and violins have been equipped with through-neck structures in which bodies and necks are formed using integral wood, set-neck structures in which necks are bonded to bodies by use of an adhesive, and bolt-on structures in which necks are fixed to bodies by use of joint screws such as wood screws and bolts. Among those structures, the bolt-on structure is superior to other structures in terms of manufacturability and manufacturing cost of stringed musical instruments and can be easily handled, compared to other structures, in replacing necks and in adjusting warps of necks since necks are detachably attached to bodies.

For example, FIGS. 3 to 6 of Japanese Utility Model Application Publication No. S63-195378 show a conventional bolt-on structure of a stringed musical instrument in which the base-end portion of a neck is held inside a recess formed on the upper surface of a body, and a joint screw is put into the lower surface of the body toward the base-end portion of the neck in the thickness direction of the body, thus fixing the neck to the body.

For example, FIGS. 1 and 2 of Japanese Utility Model Application Publication No. S63-195378 and FIG. 3 of Japanese Unexamined Patent Application Publication No. 2000-187481 show another conventional bolt-on structure of a stringed musical instrument in which the foregoing joint screw is obliquely put into the distal end of a neck in its longitudinal direction in the thickness direction of a body.

However, since the neck joint structure of a stringed musical instrument disclosed in FIGS. 3 to 6 of Japanese Utility Model Application Publication No. S63-195378 is designed such that the base-end portion of a neck is impressed onto the bottom face of the recess, which is orthogonal to the thickness direction of a body, by the joint screw, no force is exerted to impress the edge face of the base-end portion of a neck onto (the side face of) a body. In other words, no force occurs in impressing the edge face of the base-end portion of a neck onto a body in the longitudinal direction of a neck.

For this reason, even when a vibration occurs in a string of a stringed musical instrument having the above structure, it is difficult for the body and neck to integrally vibrate together irrespective of the vibration of a string, with the result that the vibration of a string may be easily attenuated in comparison with the through-neck structure and set-neck structure, leading to inability to adequately sustain sound. There is another problem such as a reduction of the sound quality and volume.

Since the edge face of the base-end portion of a neck is not depressed in the longitudinal direction of the neck in a stringed musical instrument having the above structure, a gap is formed between the edge face of the base-end portion of the neck and the body, with the result that the neck oscillates about the base-end portion thereof relative to the body in the width direction of the neck (i.e. the direction orthogonal to the thickness direction of the body and the longitudinal direction of the neck). In this case, the direction of the neck relative to the body may be deviated. That is, the direction of a string (i.e. a string-stretching direction) stretched between the distal end of the neck and the body must be deviated from the longitudinal direction of the body and the proper string-stretching direction relative to the body, causing concern that the proper string-stretching state (e.g. a performing ability and a musical interval) may not be maintained.

Since the neck joint structure of a stringed musical instrument as shown in FIGS. 1 and 2 of Japanese Utility Model Application Publication No. S63-195378 and FIG. 3 of Japanese Unexamined Patent Application Publication No. 2000-187481 is designed to use the oblique joint screw, it is capable of moving the base-end portion of the neck relative to the body in both of the thickness direction of the body and the longitudinal direction of the neck.

However, the oblique joint screw is put into the neck at the position departing from the base-end portion of the neck to its distal end, causing concern that the joint strength of the oblique joint screw applied between the body and the neck may decrease. This point will be described in detail. When an external force is applied to raise the neck along the upper surface of the body due to the "leverage effect" about the support point at the base-end portion of the neck, a large force is exerted on the oblique joint screw, which is positioned between the support point at the base-end portion of the neck and the power point at the distal end of the neck, to move in the upper direction and the thickness direction of the body. Even when the joint strength of the joint screw is intensely exerted on the joint screw in the longitudinal direction, the longitudinal direction of the oblique joint screw differs from the direction of the force exerted on the oblique joint screw due to the "leverage effect", causing concern that the joint strength of the oblique joint screw may decrease. Decreased joint strength of the joint screw may easily attenuate the vibration of a string, leading to inability to adequately sustain sound as described above. In addition, there is another problem such as a reduction of the sound quality and volume. Furthermore, there is concern that the proper string-stretching state may not be maintained.

The external force for raising the neck along the upper surface of the body includes a tensile force caused by a string stretched between the distal end of the neck and the body. Particularly, a bass guitar having a high tensile force of a string increases a force to raise the neck.

In the structure shown in FIG. 3 of Japanese Unexamined Patent Application Publication No. 2000-187481, the contact area between the base-end portion of the neck and the recess of the body is constituted of three faces having different directions. In actuality, it is difficult to simultaneously establish surface contacts on all the three faces with the woodworking precision.

SUMMARY OF THE INVENTION

The present invention is made in view of the aforementioned circumstances, and the objectivity thereof is to provide a neck joint structure for a stringed musical instrument, i.e. a bolt-on structure of a stringed musical instrument, which is capable of improving the mechanical rigidity of a fixed portion of a body and a neck, improving the durability of the stringed musical instrument by way of the joint strength of a joint member such as a joint screw, and improving the sound quality, volume, sound sustainability.

In order to solve the above problem, a neck joint structure for a stringed musical instrument according to the present invention is a neck joint structure for fixing a neck to a body of a stringed musical instrument by use of a joint member and is characterized in that a neck fixing recess which has an opening on the main face of the body in the thickness direction of the body, which has openings on the side faces of the body extending in the thickness direction, and into which at least a part of a base-end portion of the neck in the longitudinal direction is inserted is formed in the body, wherein the neck fixing recess includes a recessed end face which is brought into contact with an end face of the base-end portion constituting the base of the neck in the longitudinal direction and a recessed bottom face which is brought into contact with a main contact face of the base-end portion that forms a corner together with the end face of the neck in the thickness direction, and wherein the joint member is a slanting joint member which is screwed into the body and the neck via the corner between the recessed bottom face and the recessed end face of the body and via the corner between the main contact face and the end face of the neck in the state in which the screwing direction thereof is slanted to the distal end of the neck in the longitudinal direction relative to the thickness direction of the body and the neck.

In this connection, it is preferable that the joint member be a joint screw such as a wood screw and a bolt.

In the neck joint structure for a stringed musical instrument according to the present invention, since the base-end portion of the neck moves toward the recessed bottom face in the thickness direction of the body when the neck is fixed to the body by use of the slanting joint member, the main contact face of the neck is brought into contact with and impressed onto the recessed bottom face. Since the base-end portion of the neck moves relative to the body in the longitudinal direction of the neck as well, the end face of the neck is brought into contact with and impressed onto the recessed end face.

That is, the stringed musical instrument of this structure improves the mechanical rigidity at the fixed portion between the body and the neck. In particular, the base-end portion of the neck is impressed onto the body in the string-stretching direction corresponding to the longitudinal direction of the neck so that the body and the neck integrally vibrate together in response to the vibration of strings; hence, it is possible to suppress the excessive attenuation of the vibration of strings, and similar to the through-neck structure and the set-neck structure, it is possible to achieve the adequate sound sustainability. In addition, it is possible to suppress a reduction of the sound quality and volume in comparison with the conventional structure. Since the stringed musical instrument has this structure corresponding to the bolt-on structure, it is possible to produce the lively and attack-enhanced tone color unique to this structure.

Since the stringed musical instrument of this structure prevents the neck from oscillating about the base-end portion relative to the body in the width direction of the neck, it is possible to maintain the proper string-stretching state.

Moreover, since the main contact face of the neck is brought into contact with the recessed bottom face while the end face of the neck is brought into contact with the recessed end face with the general precision of wood-working, it is possible to easily manufacture the stringed musical instrument.

In the neck joint structure for the stringed musical instrument in which the slanting joint member is screwed into the base of the neck in the longitudinal direction, it is possible to prevent a reduction of the joint strength between the body and the neck by the slanting joint member. Even when an external force occurs to raise the neck about the support point corresponding to the base of the neck due to the "leverage effect" toward the main face of the body, a large force is not exerted on the slanting joint member disposed at the support point, thus preventing a reduction of the joint strength of the slanting joint member.

In the neck joint structure for the stringed musical instrument, when the main contact face and the end face of the neck are orthogonal, it is preferable that the slanting angle of the slanting joint member relative to the end face of the neck be less than 30° and greater than 60°.

By setting the slanting angle of the slanting joint member to 30° or more, it is possible to produce an adequate force for impressing the end face of the neck onto the recessed end face of the body, and it is possible to reliably and integrally vibrate the body and the neck in response to the vibration of strings.

By setting the slanting angle to 60° or less, it is possible to prevent an excessive length (the length in the screwing direction) of the slanting joint member, and it is possible to reliably prevent the weight and volume of the slanting joint member from affecting the stringed musical instrument in terms of the sound quality and volume, the sound sustainability, and the like. Moreover, it is possible to easily prevent the interference with a pickup device attached onto the body, and it is possible to easily process a prepared hole for the slanting joint member.

In the neck joint structure for the stringed musical instrument, it is preferable to include a plurality of joint members, at least one of which is a slanting joint member and the other of which is a vertical joint member which is screwed into the body and the neck via the recessed bottom face and the main contact face such that the screwing direction thereof lies along the thickness direction of the body.

In the above neck joint structure, the vertical joint member is shifted in position toward the distal end of the neck in comparison with the slanting joint member.

In the above neck joint structure, the joint strength of the vertical joint member is intensely exerted in the thickness direction of the body. For this reason, even when an external force occurs to raise the neck about the base of the neck due to the "leverage effect" toward the main face of the body, it is possible to reliably prevent the neck from raising toward the main face of the body due to the joint strength of the vertical joint member. In other words, it is possible to further improve the mechanical rigidity at the fixed portion between the body and the neck.

Even when a large force is exerted on the vertical joint member disposed between the support point at the base of the neck and the power point at the distal end of the neck due to the "leverage effect", it is exerted in the thickness direction of the body so as not to reduce the joint strength of the vertical joint member.

In the neck joint structure for the stringed musical instrument, the joint member may be screwed into the neck from the body.

Alternatively, the joint member may be screwed into the body from the neck.

When screwing the slanting joint member from the body, it is preferable to form a slope on the corner of the neck and orthogonal to the screwing direction of the slanting joint member, thus allowing the slanting joint member to run through the slope.

In the above structure in which the slanting joint member is vertically screwed into the slope, it is possible to precisely screw the slanting joint member into the neck via the corner of the neck without causing deviations in the slanting direction of the slanting joint member.

When forming the slope on the corner of the neck, it is preferable that the length of the slope in the thickness direction of the neck be half or less than the thickness of the base-end portion of the neck. In other words, it is preferable that the length of the slope be less than the length of the end face of the neck lying along the thickness direction of the neck.

The formation of the slope on the corner of the neck, compared to non-formation, decreases the area of the end face of the neck. By setting the aforementioned length of the slope, it is possible to secure the adequate area for the end face of the neck impressed onto the recessed end face of the body irrespective of the formation of the slope, and it is therefore possible to reliably prevent a hindrance to the improvement of the mechanical rigidity at the fixing portion between the body and the neck.

In the neck joint structure for the stringed musical instrument, the recessed bottom face and the recessed end face of the body and the main contact face and the end face of the neck are each bonded together using the adhesive.

Even when the body and the neck are fixed together using the adhesive, it is possible to reliably bring the recessed bottom face and the recessed end face of the body into close contact with the main contact face and the end face of the neck. In the process of bonding the neck to the body by use of the adhesive, the slanting joint member is used to fix the body and the neck together in advance; hence, it is possible to prevent the body and the neck from mutually moving before the adhesive is dried, and it is therefore possible to reliably bring the recessed bottom face of the body into close contact with the main contact face of the neck. In addition, it is possible to reliably bring the recessed end face of the body into close contact with the end face of the neck.

According to the present invention which aims to improve the mechanical rigidity at the fixing portion between the body and the neck, it is possible to improve the sound quality and volume and the sound sustainability. In addition, it is possible to prevent a reduction of the joint strength of the slanting joint member, and it is therefore possible to improve the durability of the stringed musical instrument.

PREFERRED EMBODIMENTS

Figure 1:
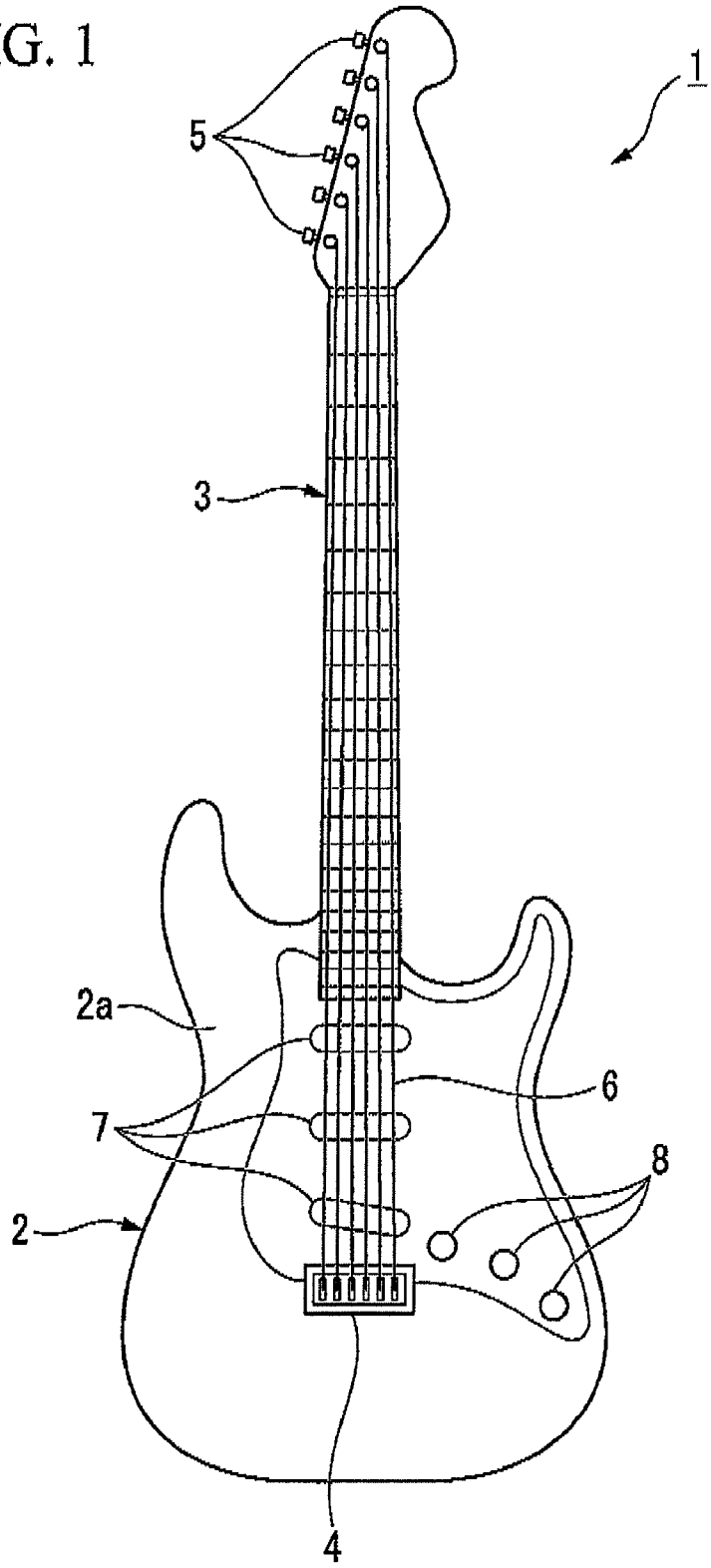
FIG. 1 is a plan view of a stringed musical instrument, viewed from the upper side of its body, equipped with a neck joint structure according to one embodiment of the present invention.

As shown in FIG. 1, a stringed musical instrument 1 according to one embodiment of the present invention is mainly constituted of a wooden body 2, a neck 3 which is fixed to the end portion of the body 2 in its surface direction and which is elongated to depart from the body 2, a pickup device 7 for converting vibrations of strings 6, which are stretched between a bridge 4 disposed on an upper face (or a main face) 2*a* of the body 2 and the distal end of the neck 3 in its longitudinal direction, into electric signals, and operators 8 such as knobs for controlling the sound volume and quality. A direction for stretching strings 6 (a string-stretching direction) agrees with the longitudinal direction of the neck 3.

The above embodiment will be described with respect to a solid-type electric guitar having a solid structure in which the body 2 does not include a hollow cavity therein; however, the present invention is applicable to other types of stringed musical instruments such as semi-acoustic electric guitars each having a hollow structure in which the body 2 has a hollow cavity therein, acoustic guitars, and violins.

Figure 2:
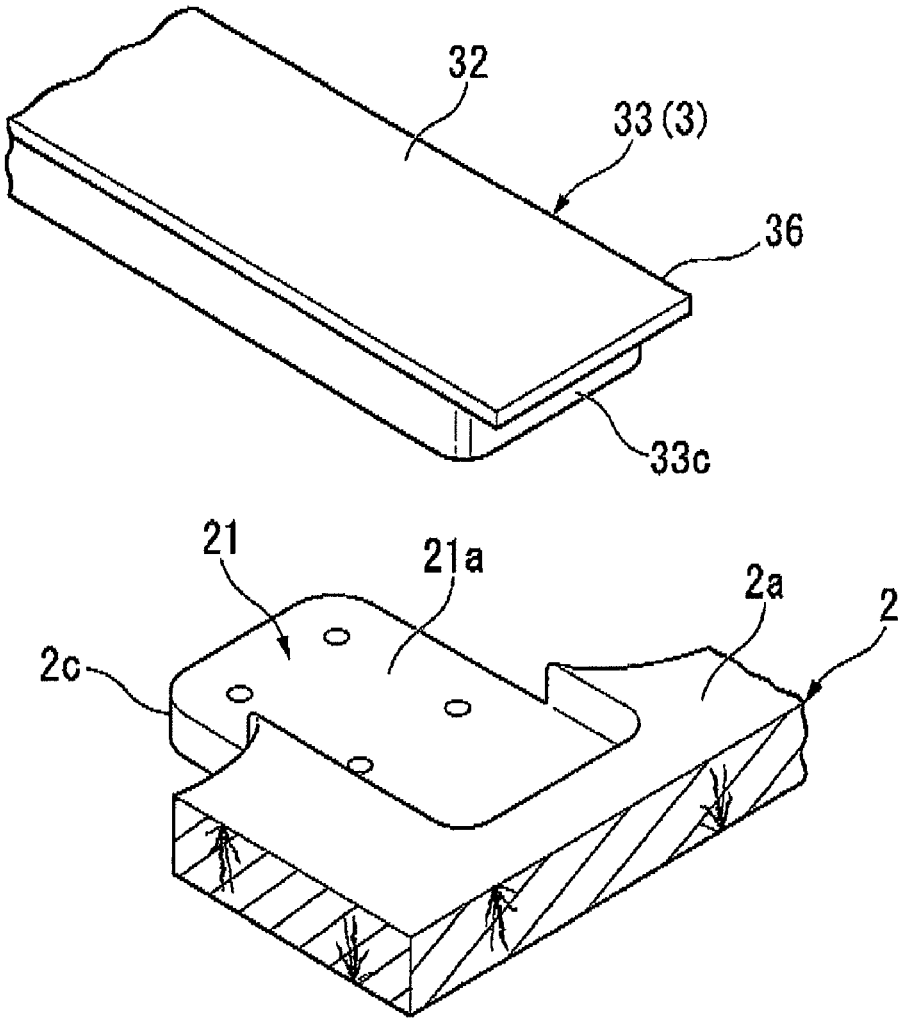
FIG. 2 is an exploded perspective view showing a neck before being fixed to the body in the neck joint structure of the stringed musical instrument shown in FIG. 1.
Figure 3:
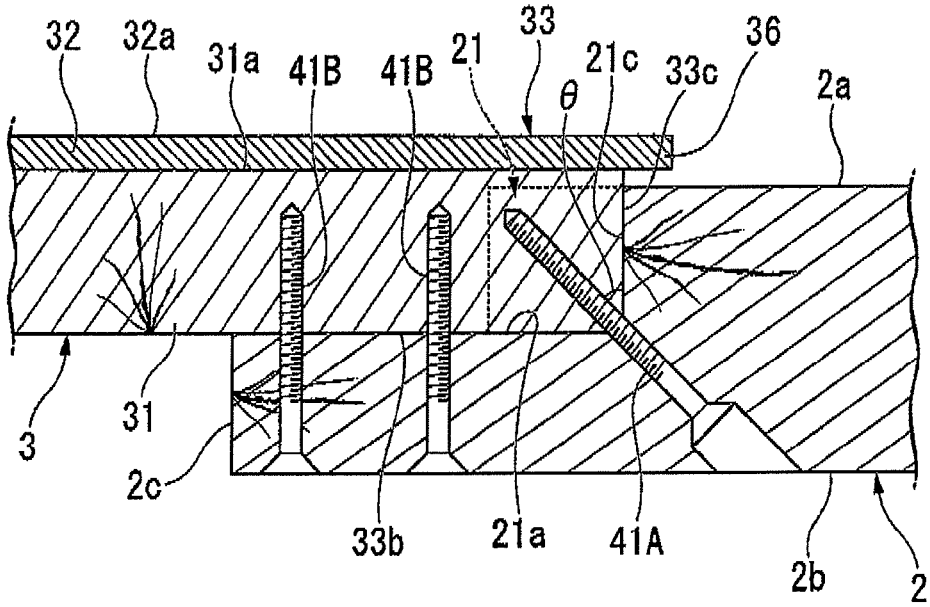
FIG. 3 is a cross-sectional view of the neck joint structure of the stringed musical instrument shown in FIG. 1.

As shown in FIGS. 2 and 3, a neck fixing recess 21 for inserting a base-end portion 33 of the neck 3 in the longitudinal direction is formed in the body 2. The neck fixing recess 21 has an opening bored in the thickness direction of the body 2 in parallel with the upper face 2*a* of the body 2 and an opening extended in the thickness direction of the body 2 in parallel with an end face 2*c* of the body 2, wherein the cross section thereof is formed in a rectangular shape.

Specifically, the neck fixing recess 21 includes a planar recessed bottom face 21*a* which sinks in the thickness direction of the body 2 in parallel with the upper face 2*a* of the body 2 and a planar recessed end face 21*c* which sinks in the face direction of the body 2 in parallel with the end face 2*c* of the body 2. Herein, the recessed bottom face 21*a* is orthogonal to the thickness direction of the body 2, while the recessed end face 21*c* lies along the thickness direction of the body 2. That is, the recessed bottom face 21*a* is orthogonal to the recessed end face 21*c*.

The neck 3 is formed by bonding a fingerboard 32 onto an upper face 31*a* of a wooden neck body 31 via the adhesive. The aforementioned strings 6 (see FIG. 1) are disposed oppositely to an upper face 32*a* of the fingerboard 32.

The base-end portion 33 of the neck 3 includes an end face 33*c* forming the edge of the neck 3 in the longitudinal direction and a planar lower contact face (or a main contact face) disposed oppositely to the upper face 32*a* of the fingerboard 32. Herein, the end face 33*c* is lies along the thickness direction of the neck 3, while the lower contact face 33*b* is orthogonal to the thickness direction of the neck 3. That is, the end face 33*c* of the neck 3 is orthogonal to the lower contact face 33*b*.

In the state in which the base-end portion 33 of the neck 3 is inserted into the neck fixing recess 21, the end face 33*c* of the neck 3 is brought into contact with the recessed end face 21*c*, so that the lower contact face 33*b* of the neck 3 is brought into contact with the recessed bottom face 21*a*.

In the illustration, the upper face 32*a* of the fingerboard 32 protrudes from the upper face 2*a* of the body 2 in the thickness direction of the body 2 in the state in which the base-end portion 33 of the neck 3 is inserted into the neck fixing recess 21. Although the base-end portion 33 of the neck 3 is partially inserted into the neck fixing recess 21, it is possible to entirely insert the base-end portion 33, for example. Considering the high-position performance, it is preferable to set dimensions of the neck fixing recess 21 and the base-end portion 33 of the neck 3 so that the upper face 32*a* of the base-end portion 33 of the neck 3 will not be disposed inside the neck fixing recess 21.

In the illustration, a protrusion 36 is formed in the fingerboard 32 such that it protrudes from the base (or the end face 33*c*) of the neck body 31 in the longitudinal direction, and it is disposed oppositely to the upper face 2*a* of the body 2 in the state in which the base-end portion 33 of the neck 3 is inserted into the neck fixing recess 21; however, it does not need to be formed. Furthermore, the protrusion 36 of the fingerboard 32 is disposed oppositely to the upper face 2*a* of the body 2 via a gap therebetween, but it can be disposed in contact with the upper face 2*a* of the body 2, for example.

In this stringed musical instrument 1, the body 2 is fixed to the neck 3 via a plurality of joint screws (or joint members) 41A and 41B in the state in which the base-end portion 33 of the neck 3 is inserted into the neck fixing recess 21. Hereinafter, the neck joint structure will be described in detail.

Figure 4:
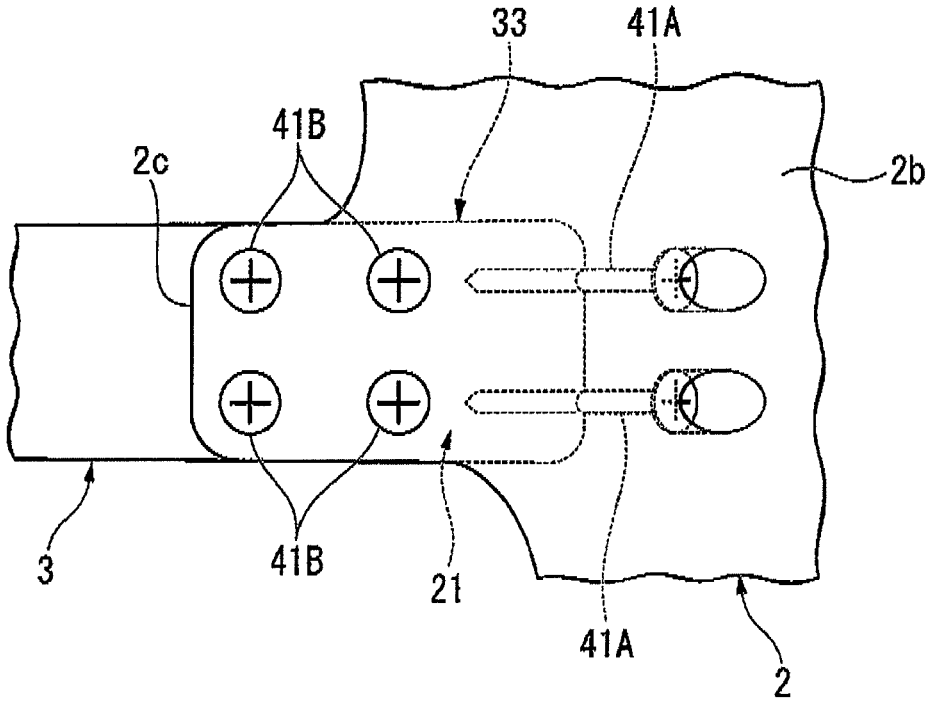
FIG. 4 is a plan view of the neck joint structure of FIG. 3 viewed from the lower side of the body.

The joint screws 41A and 41B are wood screws that can be directly screwed into wood, so that they are both screwed into the neck 3 from a lower face 2*b* of the body 2. As shown in FIGS. 3 and 4, there are two types of the joint screws 41A and 41B, i.e. slanting screws (or slant joint members) 41A whose longitudinal directions (or screwing directions) are slanted in the thickness direction of the body 2 and the neck 3 toward the distal end of the neck in its longitudinal direction, and vertical screws (or vertical joint members) whose longitudinal directions (or screwing directions) lie along the thickness direction of the neck 3.

The slanting screws 41A are screwed into the body 2 and the neck 3 via the corner between the recessed bottom face 21*a* and the recessed end face 21*c* of the body 2 and via the corner between the lower contact face 33*b* and the end face 33*c* of the neck 3. A slanting angle θ of the slanting screw 41A relative to the end face 33*c* of the neck 3 is set to be greater than 0° and less than 90°, wherein it preferably ranges from 30° to 60°, and more preferably, it is se to 45°, for example.

The vertical screws 41B are screwed into the body 2 and the neck 3 via the recessed bottom face 21*a* and the lower contact face 33*b* such that they are orthogonal to the recessed bottom face 21*a* of the body 2 and the lower contact face 33*b* of the neck 3 (i.e. orthogonal to the longitudinal direction of the neck 3).

The slanting screws 41A and the vertical screws 41B are sequentially aligned in the direction from the base to the distal end along the longitudinal direction of the neck 3.

FIGS. 3 and 4 show that two sets of the vertical screws 41B are aligned along the longitudinal direction of the neck 3, but three or more sets can be aligned; alternatively, a single vertical screw 41B can be aligned together with the slanting screw 41A in the longitudinal direction of the neck 3, for example. FIG. 4 shows an alignment pattern for aligning the slanting screws 41A and the vertical screws 41B in the longitudinal direction of the neck 3, wherein they are aligned in two lines in the width direction of the neck 3, but they can be aligned in three or more lines or in a single line, for example. In addition, the slanting screws 41A and the vertical screws 41B are precisely aligned in lines along the longitudinal direction of the neck 3, wherein it is required that the vertical screws 41B be shifted in position toward the distal end of the neck 3 so as not to interfere with the slanting screws 41A; hence, the slanting screws 41A can be deflected in position from the vertical screws 41B in the width direction of the neck 3.

As described above, according to the neck joint structure of the stringed musical instrument 1 of the present embodiment, when the neck 3 is fixed to the body 2 via the slanting screw 41A, the base-end portion 33 of the neck 3 moves relative to the body 2 toward the recessed bottom face 21*a* in the thickness direction of the body 2, so that the lower contact face 33*b* of the neck 3 is brought into contact with and impressed onto the recessed bottom face 21*a*. At this time, the base-end portion 33 of the neck 3 moves relative to the body 2 toward the recessed end face 21*c* as well, so that the end face 33*c* of the neck 3 is brought into contact with and impressed onto the recessed end face 21*c*.

That is, the stringed musical instrument 1 having the above structure improves the mechanical rigidity at the joint portion between the body 2 and the neck 3, thus improving the sound quality and volume as well as the sound sustainability. In particular, since the base-end portion 33 of the neck 3 is impressed onto the body 2 in the string-stretching direction corresponding to the longitudinal direction of the neck 3, the vibration of the strings 6 leads to the integral vibration of the body 2 and the neck 3, which in turn suppresses the excessive attenuation of vibration of the strings 6, thus achieving the adequate sound sustainability similar to the through-neck structure and the set-neck structure. In addition, the above structure is capable of suppressing a reduction of the sound quality and volume in comparison with the conventional structure. In this connection, the above structure of the stringed musical instrument 1 is the bolt-on structure, which is capable of generating a unique, lively, and attack-enhanced tone color in comparison with the through-neck structure and the set-neck structure.

Since the end face 33*c* of the neck 3 is impressed onto the recessed end face 21*c* of the body 2, it is possible to prevent the neck 3 from oscillating about the base-end portion 33 relative to the body 2 in the width direction of the neck, thus it is possible to maintain the proper string-stretched state.

In addition, the present embodiment allows for the general precision of wood-working in bringing the lower contact face 33*b* of the neck 3 in contact with the recessed bottom face 21*a* and in bringing the end face 33*c* of the neck 3 into contact with the recessed end face 21*c*; hence, it is possible to easily manufacture the stringed musical instrument 1.

Since the slanting screws 41A are screwed into the base of the neck 3 in the longitudinal direction, it is possible to prevent a reduction of the joint strength between the body 2 and the neck 3 via the slanting screws 41A. That is, even when an external force occurs to raise the neck 3 on the upper face 2*a* of the body 2 due to the "leverage effect" exerted about the support point at the base of the neck 3, a large force is not exerted on the slanting screws 41A disposed at the support point, which does not cause a reduction of the joint strength of the slanting screws 41A. Therefore, it is possible to improve the durability of the stringed musical instrument 1.

By setting the slanting angle θ of the slanting screw 41A to 30° or more, it is possible to obtain an adequate force for impressing the end face 33*c* of the neck 33 onto the recessed end face 21*c* of the body 2, and it is possible to reliably cause the integral vibration of the body 2 and the neck 3 in response to the vibration of the strings 6.

By setting the slanting angle θ to 60° or less, it is possible to prevent the slanting screw 41A from being excessively elongated, it is possible to reliably prevent the weight and volume of the slanting screw 41A from affecting the sound quality and volume and the sound sustainability of the stringed musical instrument 1, and it is possible to easily screw the slanting screws 41A into the body 2 and the neck 3.

When the slanting angle θ of the slanting screw 41A is set to 45°, it is possible to uniformly set the force for impressing the lower contact face 33*b* of the neck 3 onto the recessed bottom face 21*a* and the force for impressing the end face 33*c* of the neck 3 onto the recessed end face 21*c* based on the slanting screws 41A screwed into the body 2 and the neck 3.

By using the vertical screws 41B in addition to the slanting screws 41A, it is possible to further improve the mechanical rigidity at the joint portion between the body 2 and the neck 3. Specifically, even when an external force occurs to raise the neck 3 on the upper face 2*a* of the body 2 due to the "leverage effect" exerted about the support point at the base of the neck 3, it is possible to reliably prevent the neck 3 from raising on the upper face 2*a* of the body 2 due to the joint strength of the vertical screws 41B.

Even when a large force is exerted on the vertical screws 41B, which are interposed between the support point at the base of the neck 3 and the power point at the distal end of the neck 3, due to the external force caused by the "leverage effect", it is exerted in the thickness direction of the body 2; hence, it does not reduce the joint strength of the vertical screws 41B.

Figure 5:
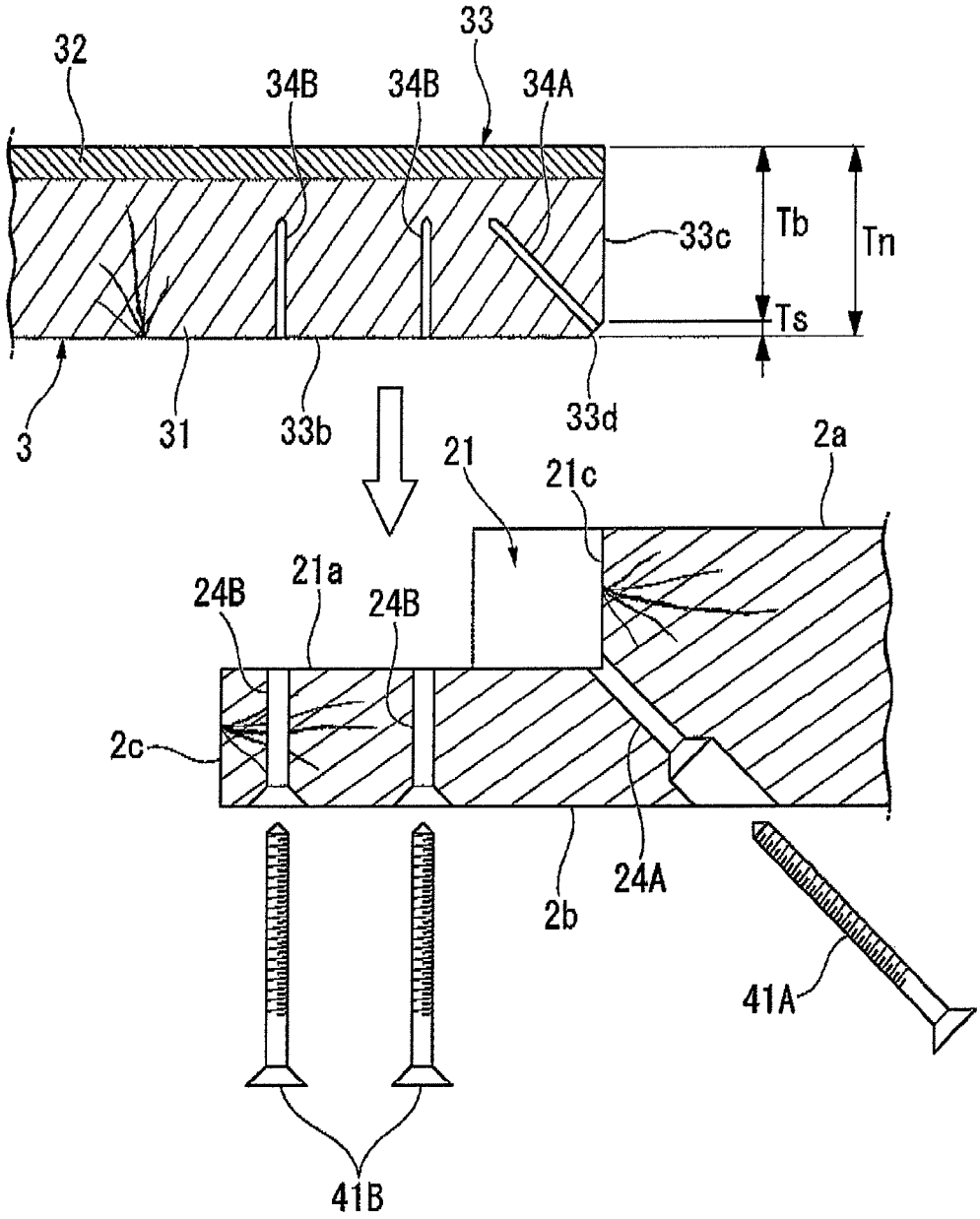
FIG. 5 is an exploded sectional view showing the neck before being fixed to the body in a neck joint structure of a stringed musical instrument according to another embodiment of the present invention.
Figure 6A:
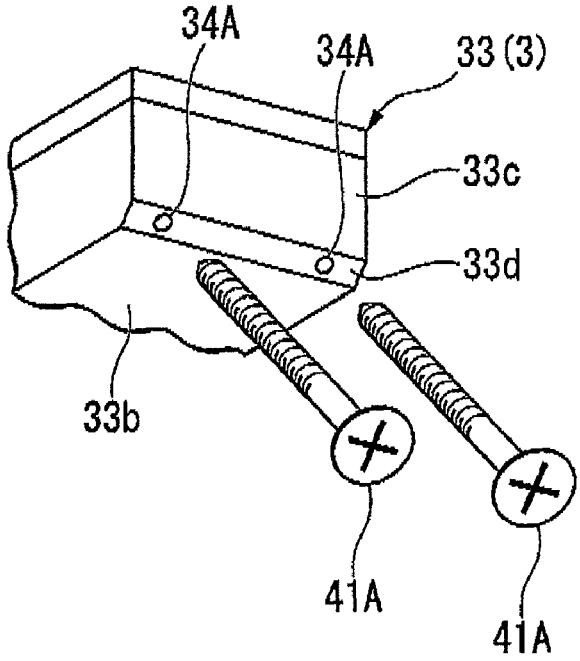
FIG. 6A is a perspective view showing an example of a slope of the neck in the neck joint structure of FIG. 5.
Figure 6B:
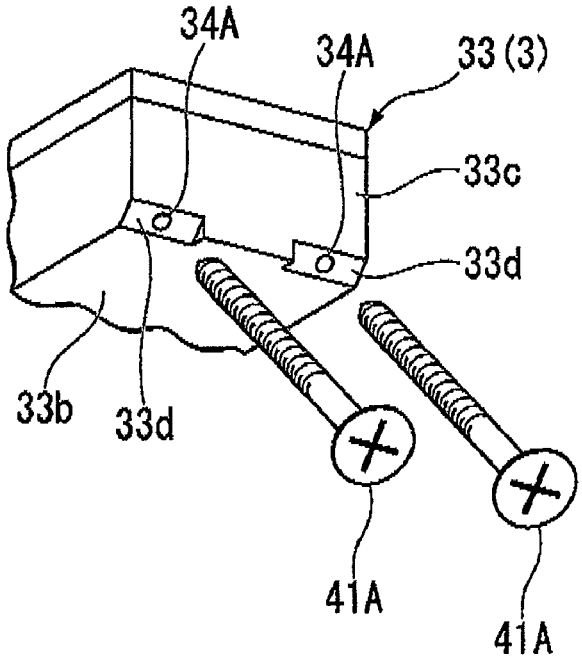
FIG. 6B is a perspective view showing another example of a slope of the neck in the neck joint structure of FIG. 5.

In the present embodiment in which the slanting screws 41A are screwed into the neck 3 via the body 2, it is preferable that a slope 33*d* orthogonal to the longitudinal direction of the slanting screws 41A be formed on the corner between the lower contact face 33*b* and the end face 33*c* of the neck 3 as shown in FIGS. 5, 6A, and 6B, whereby the slanting screws 41A are screwed into the neck 3 to penetrate through the slope 33*d*, for example.

In FIG. 5, the through-holes running through the neck fixing recess 21 from the lower face 2*b* of the body 2 and the closed-end holes whose openings are disposed on the corner of the lower contact face 33*b* of the neck 3 are prepared holes 24A, 24B, 34A, and 34B via which the wood screws serving as the joint screws 41A and 41B are screwed into the body 2 and the neck 3. The diameters of the prepared holes 34A and 34B formed in the neck 3 are smaller than the outer diameters of the joint screws 41A and 41B. The diameters of the prepared holes 24A and 24B formed in the body 2 slightly larger than the outer diameters of the joint screws 41A and 41B; however, they may be identical to or smaller than the outer diameters of the joint screws 41A and 41B, for example. The directions of the prepared holes 24A, 24B, 34A, and 34B agree to the screwing directions of the joint screws 41A and 41B.

As shown in FIG. 6A, the slope 33*d* of the neck 3 is formed entirely on the corner between the lower contact face 33*b* and the end face 33*c* of the neck 3 in the width direction of the neck 3, whereas, as shown in FIG. 6B, it may be formed only on areas receiving the slanting screws 41A in the corner between the lower contact face 33*b* and the end face 33*c* of the neck 3, for example.

In the above structure, it is preferable that a length Ts of the slope 33*d* along the thickness direction of the neck 3 be half or less than thickness Tn of the neck 3 at its base. In other words, it is preferable that the length Ts of the slope 33*d* be less than a length Tb of the end face 33*c* of the neck 3 along the thickness direction of the neck 3. It is preferable that the minimum length of the slope 33*d* along the thickness direction of the neck 3 be set to entirely cover the openings of the prepared holes 34A.

In the above structure in which the slope 33*d* is formed on the neck 3 so that the slanting screws 41A can be vertically screwed into the slope 33*d*, it is possible to prevent deviations of the slanting angle θ of the slanting screw 41A relative to the end face 33*c* of the neck 3, and it is therefore possible to precisely screw the slanting screws 41A into the neck 3 via the corner of the neck 3.

During the formation of the prepared holes 34A for the slanting screws 41A by use of a drill, its distal end is vertically put onto the slope 33*d* as shown in FIG. 5; hence, it is possible to prevent the distal end of the drill from being deviated from the corner of the neck 3, and it is therefore possible to precisely form the prepared holes 34A with the desired slanting angle θ.

Due to the formation of the slope 33*d* on the corner of the neck 3, compared to the non-formation, the area of the end face 33*c* of the neck 3 decreases, whereas since the length Ts of the slope 33*d* is half or less than the thickness Tn of the neck 3, it is possible to secure an adequate area of the end face 33*c* of the neck 3 which is impressed onto the recessed end face 21*c* of the body 2 irrespective of the formation of the slope 33*d*. Therefore, it is possible to reliably avoid a hindrance to the improvement of the mechanical rigidity at the joint portion between the body 2 and the neck 3.

Figure 7:
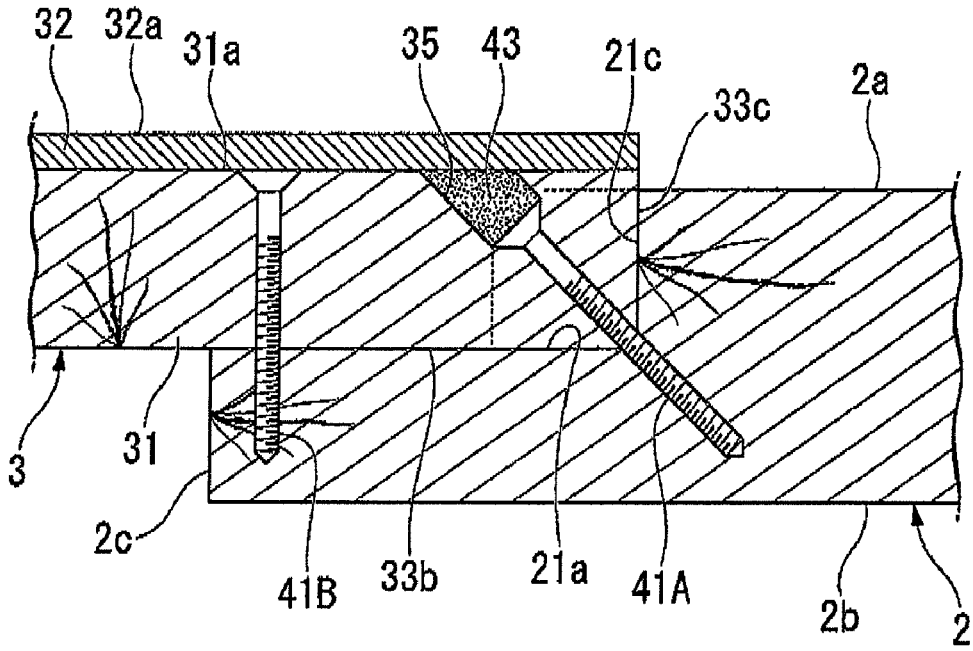
FIG. 7 is a cross-sectional view showing a neck joint structure of a stringed musical instrument according to a further embodiment of the present invention.

The present embodiment stipulates that the joint screws 41A and 41B are screwed into the neck 3 via the body 2; however, they may be screwed into the body 2 via the neck 3 as shown in FIG. 7, for example. In this case, it is preferable that the joint screws 41A and 41B be disposed to prevent the heads of the joint screws 41A and 41B from protruding from the upper face 32*a* of the neck 3 in consideration of the high-position performance. In addition, it is preferable that the joint screws 41A and 41B be screwed into the neck body 31 before the fingerboard 32 is bonded onto the neck body 31. Furthermore, it is preferable that, in order to prevent a hollow cavity from being formed inside the neck 3 by an internal thread (particularly, an internal thread 35 allowing for the slanting screw 41A screwed therein) having an opening on the upper face 31*a* of the neck body 31, the internal thread 35 be filled with an adhesive 43 and the like.

The slanting screws 41A and 41B are not necessarily formed using wood screws; hence, they can be formed using bolts, for example. In this case, internal threads such as rasp-cut nuts are inserted in advance, wherein bolts are screwed into the neck 3 via the body 2 and are then engaged with the internal threads.

In the above, the slanting screws 41A and the vertical screws 41B are used to fix the body 2 and the neck 3, although it is required that at least the slanting screws 41A be used to fix them; hence, it is possible to use other joint screws whose screwing directions differ from those of the slanting screws 41A and the vertical screws 41B, for example.

The joint screws 41A and 41B are not necessarily used to fix the body 2 and the neck 3, although it is possible to use joint members which are screwed into the body 2 and the neck 3 so as to make the body 2 and the neck 3 approach mutually.

In the above neck joint structure of the stringed musical instrument, the recessed bottom face 21*a* and the recessed end face 21*c* of the body 2 are respectively bonded to the lower contact face 33*b* and the end face 33*c* of the neck 3 via the adhesive, for example.

Even though the body 2 and the neck 3 are bonded together using the adhesive, it is possible to reliably bring the recessed bottom face 21*a* and the recessed end face 21*c* of the body 2 into close contact with the lower contact face 33*b* and the end face 33*c* of the neck 3. Since the body 2 and the neck 3 are fixed in advance by use of the slanting screws 41A when the neck 3 is bonded to the body 2 by use of the adhesive, it is possible to prevent the body 2 and the neck 3 from mutually moving until the adhesive is dried, and it is therefore possible to reliably bring the recessed bottom face 21*a* of the body 2 in close contact with the lower contact face 33*b* of the neck 3. In addition, it is possible to reliably bring the recessed end face 21*c* in close contact with the end face 33*c* of the neck 3.

The lower contact face 33*b* of the neck 3 is not necessarily orthogonal to the thickness direction of the neck 3, wherein it may cross the thickness direction of the neck 3 unless it lies orthogonal to the longitudinal direction of the slanting screw 41A. In other words, the lower contact face 33*b* of the neck 3 needs to lie along the thickness direction of the neck 3. Similarly, the end face 33*c* of the neck 3 does not necessarily lie along the thickness direction of the neck 3, wherein it may cross the thickness direction of the neck 3 unless it lies orthogonal to the longitudinal direction of the slanting screw 41A, for example. Furthermore, although it is described above that the lower contact face 33*b* and the end face 33*c* of the neck 3 are orthogonal to each other, they may cross each other so as to form the corner therebetween.

As described above, the lower contact face 33*b* of the neck 3 may be slanted to the end face 33*c* of the neck 3 so that the thickness of the neck 3 increases or decreases in the direction from the base to the distal end of the neck 3 in the longitudinal direction. In other words, the lower contact face 33*b* of the neck 3 may be slanted to both the longitudinal direction and the thickness direction of the neck 3.

In this connection, the recessed bottom face 21*a* and the recessed end face 21*c* of the body 2 need to come in contact with the lower contact face 33*b* and the end face 33*c* of the neck respectively.

The neck 3 is not necessarily constituted of the neck body 31 and the fingerboard 32 which join together, but it can be produced by integrally forming the neck body 31 and the fingerboard 32 by use of a single piece of wood, for example.

Furthermore, the neck 3 is not necessarily fixed onto the upper face 2*a* of the body 2 in the present embodiment, wherein it can be fixed onto the lower face 2*b* of the body 2, for example.

In this case, the neck fixing recess having openings at the lower face (or one main surface) 2*b* and the side faces 2*c* is formed in the body 2, wherein, similar to the present embodiment, the neck joint structure needs to have the recessed end face and the recessed bottom face which is recessed in the thickness direction on the lower face 2*b* of the body 2. In addition, a step-difference portion which is recessed in the thickness direction of the neck 3 on the upper face 32*a* of the neck 3 is formed in the base-end portion 33 of the neck 3, wherein the end face which forms the base of the neck 3 and which comes in contact with the recessed end face, and the upper contact face (or main contact face) which comes in contact with the recessed bottom face are formed in the step-difference portion.

Similar to the present embodiment, the slanting screws are forced to run through the corner between the recessed bottom face and the recessed end face of the body 2 and the corner between the upper contact face and the end face of the neck 3 in the state in which the step-difference portion is inserted into the neck fixing recess.

In the above, the present invention is described in detail with reference to the accompanying drawings by way of embodiments, wherein the specific constitution thereof is not necessarily limited to those embodiments; hence, it may embrace variations consistent with the essential matters of the present invention.

What is claimed is:

1. A neck joint structure for fixing a neck to a body of a stringed musical instrument by use of a joint member, said neck joint structure for the stringed musical instrument characterized in that a neck fixing recess which has an opening on a main face of the body in the thickness direction of the body, which has openings on side faces of the body extending in the thickness direction, and into which at least a part of a base-end portion of the neck in the longitudinal direction is inserted is formed in the body, wherein the neck fixing recess includes a recessed end face which is brought into contact with an end face of the base-end portion constituting the base of the neck in the longitudinal direction and a recessed bottom face which is brought into contact with a main contact face of the base-end portion that forms a corner together with the end face of the neck in the thickness direction, and wherein the joint member is a slanting joint member which is screwed into the body and the neck via the corner between the recessed bottom face and the recessed end face of the body and via the corner between the main contact face and the end face of the neck in a state in which the screwing direction thereof is slanted to the distal end of the neck in the longitudinal direction relative to the thickness direction of the body and the neck.

2. The neck joint structure for a stringed musical instrument according to claim 1, wherein the joint member is a joint screw.

3. The neck joint structure for a stringed musical instrument according to claim 1, wherein the main contact face and the end face of the neck are orthogonal to each other, and wherein the slanting angle of the joint member relative to the end face of the neck is greater than 30° and less than 60°.

4. The neck joint structure for a stringed musical instrument according to claim 1 further comprising a plurality of joint members, at least one of which is a slanting joint member and the other of which is a vertical joint member which is screwed into the body and the neck via the recessed bottom face and the main contact face such that the screwing direction thereof lies along the thickness direction of the body.

5. The neck joint structure for a stringed musical instrument according to claim 1, wherein the joint member is screwed into the neck from the body.

6. The neck joint structure for a stringed musical instrument according to claim 5, wherein a slope orthogonal to the screwing direction of the slanting joint member is formed on the corner of the neck so that the slanting joint member runs through the slope.

7. The neck joint structure for a stringed musical instrument according to claim 6, wherein the length of the slope along the thickness direction of the neck is half or less than the thickness of the neck at the base of the neck.

8. The neck joint structure for a stringed musical instrument according to claim 1, wherein the joint member is screwed into the body from the neck.

9. The neck joint structure for a stringed musical instrument according to claim 1, wherein the recessed bottom face and the recessed end face of the body and the main contact face and the end face of the neck are each bonded together using an adhesive.

* * * * *